US005934794A

United States Patent [19]

Hutton

[11] Patent Number: 5,934,794

[45] Date of Patent: Aug. 10, 1999

[54] PROJECTION GATE APPARATUS HAVING AN AXIALLY-TRANSLATABLE MOUNT

[75] Inventor: Richard W. Hutton, Dallas, Tex.

[73] Assignee: Vari-Lite, Inc., Dallas, Tex.

[21] Appl. No.: 08/941,172

[22] Filed: Sep. 30, 1997

[51] Int. Cl.[6] ..... F21V 21/28

[52] U.S. Cl. ..... 362/283; 362/323

[58] Field of Search ..... 362/281, 283, 362/293, 322, 323

[56] References Cited

U.S. PATENT DOCUMENTS

| | | | |
|---|---|---|---|
| 5,426,576 | 6/1995 | Hewlett | 362/283 |
| 5,691,886 | 11/1997 | Stacy | 362/283 |
| 5,816,690 | 10/1998 | Romano et al. | 362/281 |
| 5,828,485 | 10/1998 | Hewlett | 359/291 |

*Primary Examiner*—Sandra O'Shea
*Assistant Examiner*—Todd Reed Hopper
*Attorney, Agent, or Firm*—Hughes & Luce, L.L.P.

[57] ABSTRACT

An optical system for an image projector luminaire includes a variable-focus lens having a depth-of-field adjustable as to location along an optical axis, and two carriages each supporting at least one image pattern generator at separate locations along the optical axis, at least one of those carriages being adjustable as to location along the optical axis. The system is operable to bring either or both image pattern generators into focus. Each carriage may support pattern generator exchanger mechanisms for selecting one of a plurality of available patterns, and may also rotate the selected pattern. The movable carriage, the lens, and the pattern exchanger mechanisms may all be motorized and operable by remote or computer control.

16 Claims, 6 Drawing Sheets

PROJECTION GATE APPARATUS HAVING AN AXIALLY-TRANSLATABLE MOUNT

FIELD OF THE INVENTION

The present invention relates generally to stage lighting instruments, and particularly to an image-projector luminaire having an axially-translatable mount for moving an image pattern generator along the optical axis of the luminaire.

DESCRIPTION OF RELATED ART

Prior art image pattern projector luminaires have evolved from the ellipsoidal spot luminaire with a stamped steel stencil-like pattern inserted in a projection gate, to motorized pattern exchangers such as those shown in U.S. Pat. Nos. 4,392,187; 4,779,176; 5,537,303; 4,891,738; and 5,113,332. These pattern exchangers provide simple and durable means for inserting one of a selection of image pattern generators or "gobos" into a projection optical system and for removing the generator therefrom. Certain of these pattern exchangers provide various means for rotating the pattern generator within the beam to provide for rotating or controlling the orientation of the projected image.

Motorized means for adjusting a projection lens are shown in U.S. Pat. Nos. 4,709,311; and 5,029,992 which are incorporated herein by reference. These provide means for controlling the quality of a projected image, which means can be operated by remote control to bring a projected image into or out of focus. In projection luminaires having plural sequential image pattern generators, adjustment of the lens can bring either of two image pattern generators into focus while the other goes out of focus, thereby "morphing" from one image to the other.

While it is known that two image pattern generators can be brought into focus at the same time if both pattern generators lie within a depth of field of the projection lens, both pattern generators will always be in focus whenever either one is in focus so that morphing between them is not possible. Further, the depth of field of a high-performance projection lens may be small, preventing or making difficult the operation of two adjacent motorized pattern exchangers.

SUMMARY OF THE INVENTION

It is an object of the invention to provide a motorized mechanism for exchanging image pattern generators or "gobos" within a projection optical system that provides a carriage for at least two gobos in the system at the same time and provides means for bringing either or both gobos into focus.

In accordance with the present invention, a projection optical system includes a lamp coupled with a reflector projecting a light beam along an optical axis, a projection gate apparatus, and a projection lens. The projection gate apparatus includes a fixed gobo carriage and a movable gobo carriage, the movable gobo carriage being movable along the axis of the light beam. The projection lens is adjustable as to the location of its object plane along the optical axis; the lens and the movable gobo carriage being operable to bring either or both gobos into focus.

DETAILED DESCRIPTION

Figure 1:
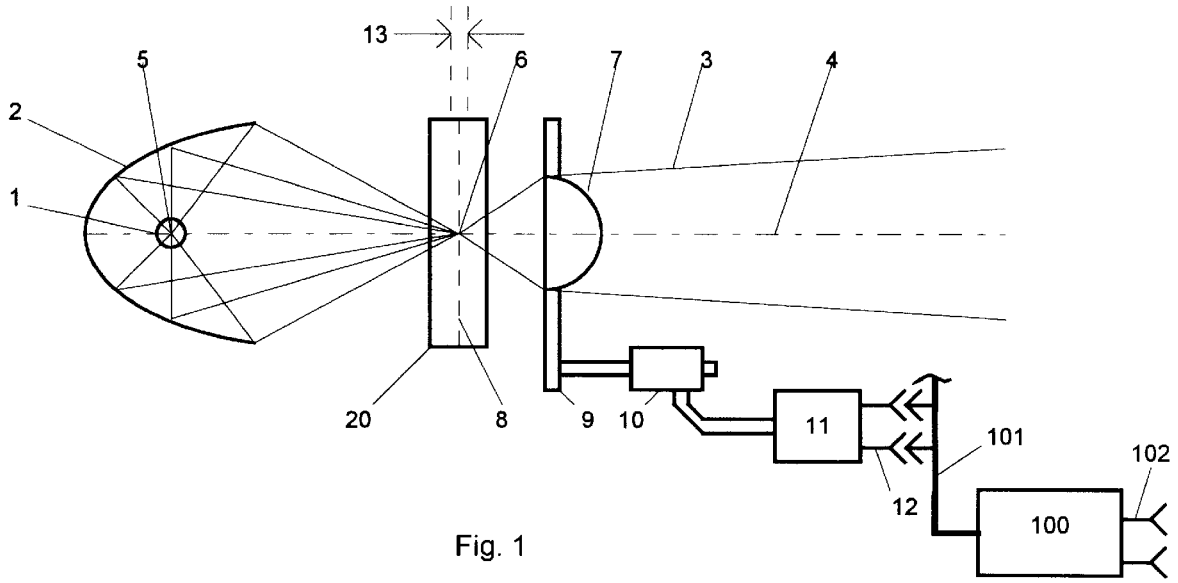
FIG. 1 is a schematic side elevation of an optical system for an image projector luminaire.

FIG. 1 shows a typical optical system for a projector luminaire. A lamp 1 coupled with an elliptical reflector 2 projects a light beam 3 along an optical axis 4. The lamp is located at a first focal point 5 of the reflector, the lamp and reflector comprising an illumination system for illuminating a projection gate. Alternatively, the illumination system may include a lamp coupled with a spherical or other reflector and a condenser lens. A projection gate apparatus 20 located along the optical axis near a minimal focus 6 of the reflector controls the shape of the beam, including the forming of images by the projected beam. A lens 7 located along the optical axis projects an image of an object at the object plane 8 located at a certain distance behind the lens and within the projection gate apparatus.

The lens is supported by a movable carriage 9, the carriage being movable along the optical axis so as to form a focused image of the object within the projection gate apparatus. The object plane, located a certain distance behind the lens, possesses a certain depth-of-field characteristic 13, the distance to the object plane and the extent of the depth-of-field being dependent upon the design of the lens. The location of the object plane is adjusted by moving the lens. A motorized mechanism 10 coupled to the lens carriage can be operated by remote control or by computer control via a motor drive circuit 11 having control input terminals 12.

Figure 2:
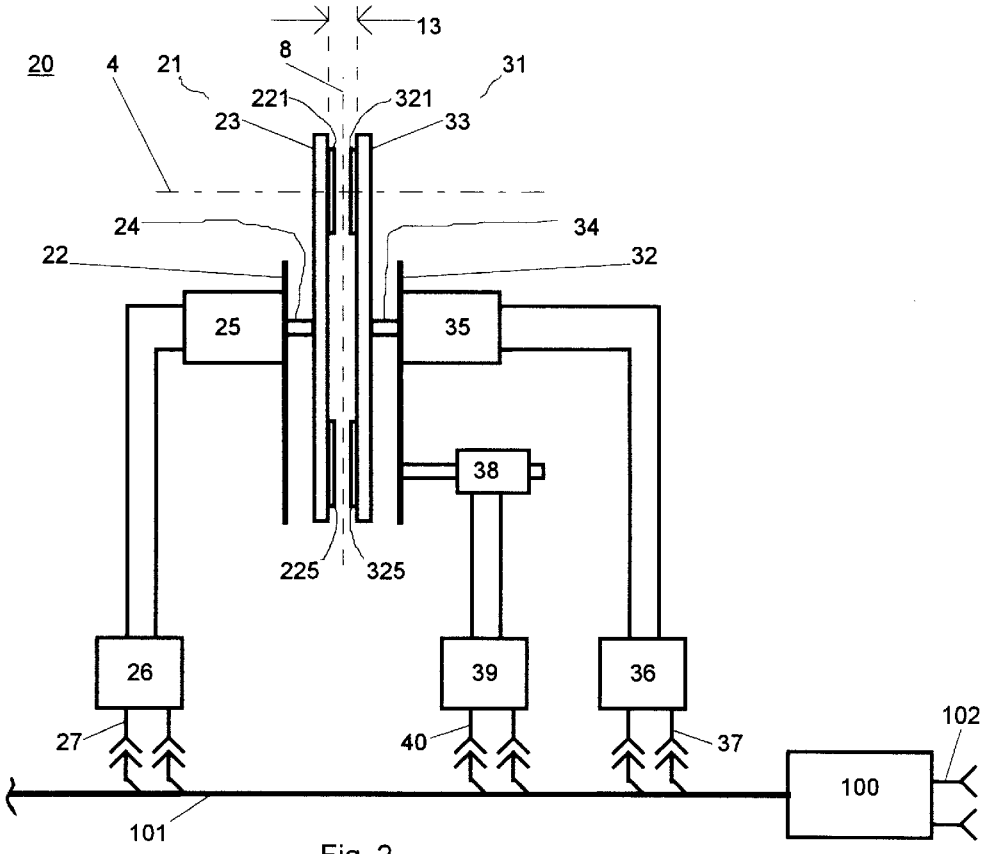
FIG. 2 is a schematic side elevation of a projection gate apparatus according to one aspect of the present invention.
Figure 3:
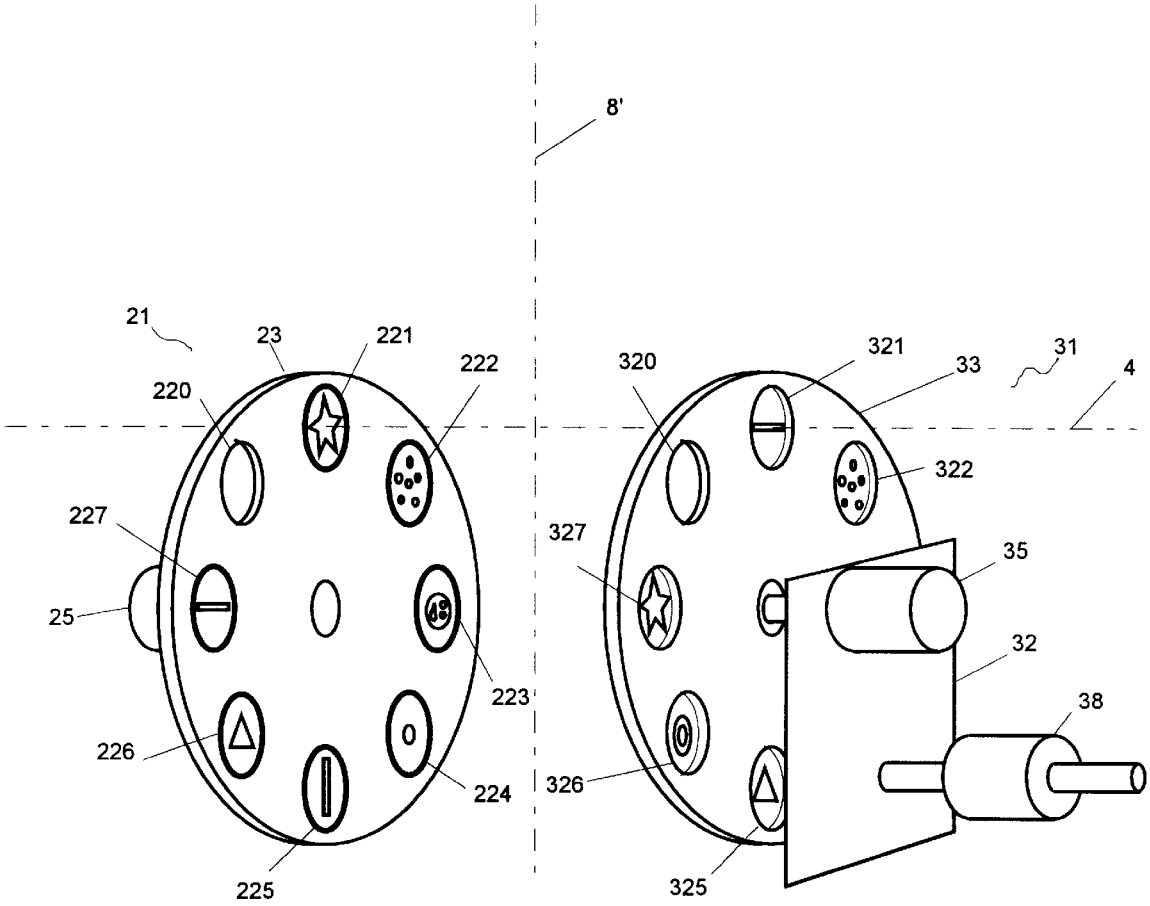
FIG. 3 is a perspective view of a projection gate apparatus according to one aspect of the present invention.

The projection gate apparatus 20, according to one aspect of the present invention as shown in FIG. 2, includes a first gobo carriage 21 and a second gobo carriage 31 disposed on either side of object plane 8. As shown in FIG. 3 with the first and second gobo carriages separated for clarity and the location of the object plane represented by a center line 8', first gobo carriage 21 has a plurality of gobos 221–227 mounted about the periphery of a wheel 23, the wheel being mounted on the shaft 24 of a reversible electric motor 25 mounted to a support 22(see also FIG. 2). The motor can be energized in a forward or reverse direction via a motor drive circuit 26 having control input terminals 27 to position a selected one the plurality of gobos in the beam path. The wheel preferably includes an open position 220 comprising a clear aperture in which no image is formed.

As shown in FIG. 2 and FIG. 3, second gobo carriage 31 has a plurality of gobos 321–327 mounted about the periphery of a wheel 33, the wheel being mounted on the shaft 34 of a reversible electric motor 35 driven by a motor drive circuit 36 having control input terminals 37. The second gobo carriage is supported by a movable support carriage 32, the support carriage being movable along the optical axis so as to position a selected gobo close enough to a selected gobo of the first gobo carriage such that both gobos lie within the depth of field of the lens when focused on the first gobo carriage. A motorized mechanism or linear translator 38 comprising, for example, a motor and a lead screw coupled to support carriage 32, can be operated by remote control or by computer control via a motor drive circuit 39 having control input terminals 40. All of the motor drive circuits, such as 11, 26, 36, and 39, may be connected via their respective input terminals to a motor control bus 101, which is energized by a controller 100 having input terminals 102 for connection to remote control means. The controller 100 may comprise a local de-multiplexer circuit such as that shown in U.S. Pat. No. 4,392,187 (incorporated herein by reference). Alternatively, controller 100 may comprise a local processor-based circuit such as that shown in U.S. Pat. No. 4,980,806 (incorporated herein by reference).

In operation, first gobo carriage 21 is operated to position a first selected gobo 221 in the beam path, second gobo carriage 31 is operated to position a second selected gobo 321 in the beam path, and lens carriage 9 is operated to focus the lens upon one or the other images formed by the selected gobos. The lens carriage can be operated in one direction to bring the first image, formed by gobo 221, into focus and can then be operated in an opposite direction to bring the second image, formed by gobo 321, into focus while the first image goes out of focus, thereby morphing from the first image to the second image.

Alternatively, support carriage 32 can be operated simultaneously with lens carriage 9 to move the second gobo 321 adjacent to the first gobo 221, within the depth-of-field of the lens, while the lens is moved concomitantly to keep the second image in focus. Note that the depth-of-field of the lens can be as small as 0.050 inches (1.27 mm). When the first gobo and the second gobo are located within the depth-of-field of the lens, and the lens is focused on either gobo, then both images formed thereby are in focus. A compound image is formed comprising elements of the first image and the second image.

Thereafter, support carriage 32 can be operated simultaneously with lens carriage 9 to move the second gobo 321 away from the first gobo 221, while the lens is moved concomitantly to keep the second image in focus. As the lens 7 moves, the object plane 8 of the lens is moved away from first gobo so that the first image formed thereby goes out of focus, while the second gobo is moved concomitantly to keep the second gobo in the object plane. The compound image dissolves into the second image as elements of the first image go out of focus. Alternatively, the lens may be initially focused on both gobos, and the lens held stationary while support carriage 32 moves second gobo 321 away from first gobo 221, thereby dissolving the image of the second gobo so that only the first gobo remains to form a projected image. A preferred embodiment of the present invention provides that the image-forming planes of the two gobos lie on or about adjacent faces of their respective gobo carriages, rather than being on opposing faces thereof, so that the imaging-forming planes might be positioned as closely as possible longitudinally within the depth-of-field of the lens. This enables the two images to be brought into sharp focus both at the same time, as desired.

The above-described apparatus provides motorized means for focusing a projection lens on a selected one or both of two image pattern generators (gobos) placed in a light beam, and enables a method for gradually introducing an image into a light beam or removing the image from the beam, for gradually transitioning from one image to another, and for gradually transitioning from a compound image to a single image or vice versa.

Figure 4:
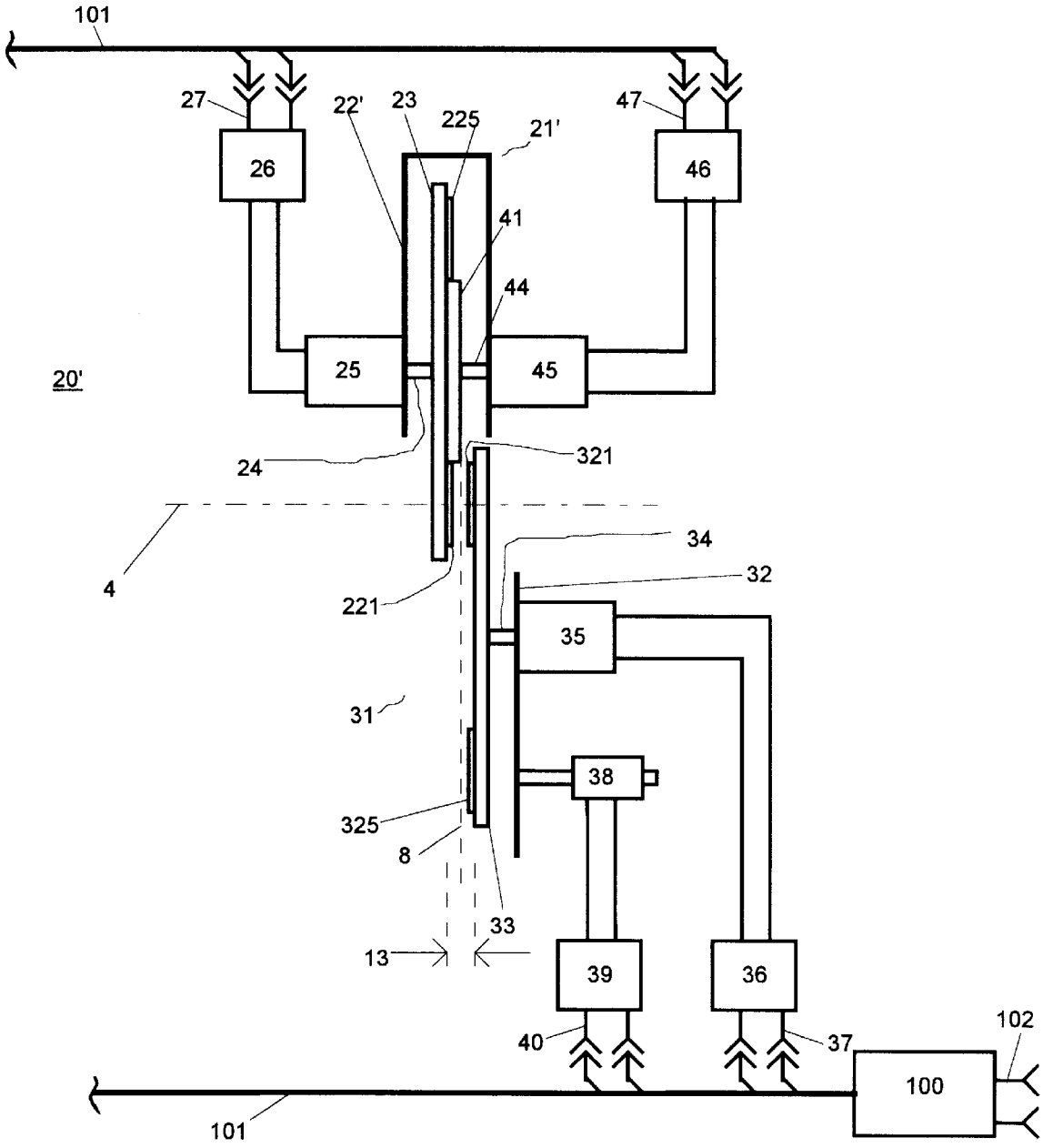
FIG. 4 is a schematic side elevation of a projection gate apparatus according to a second aspect of the present invention.
Figure 5:
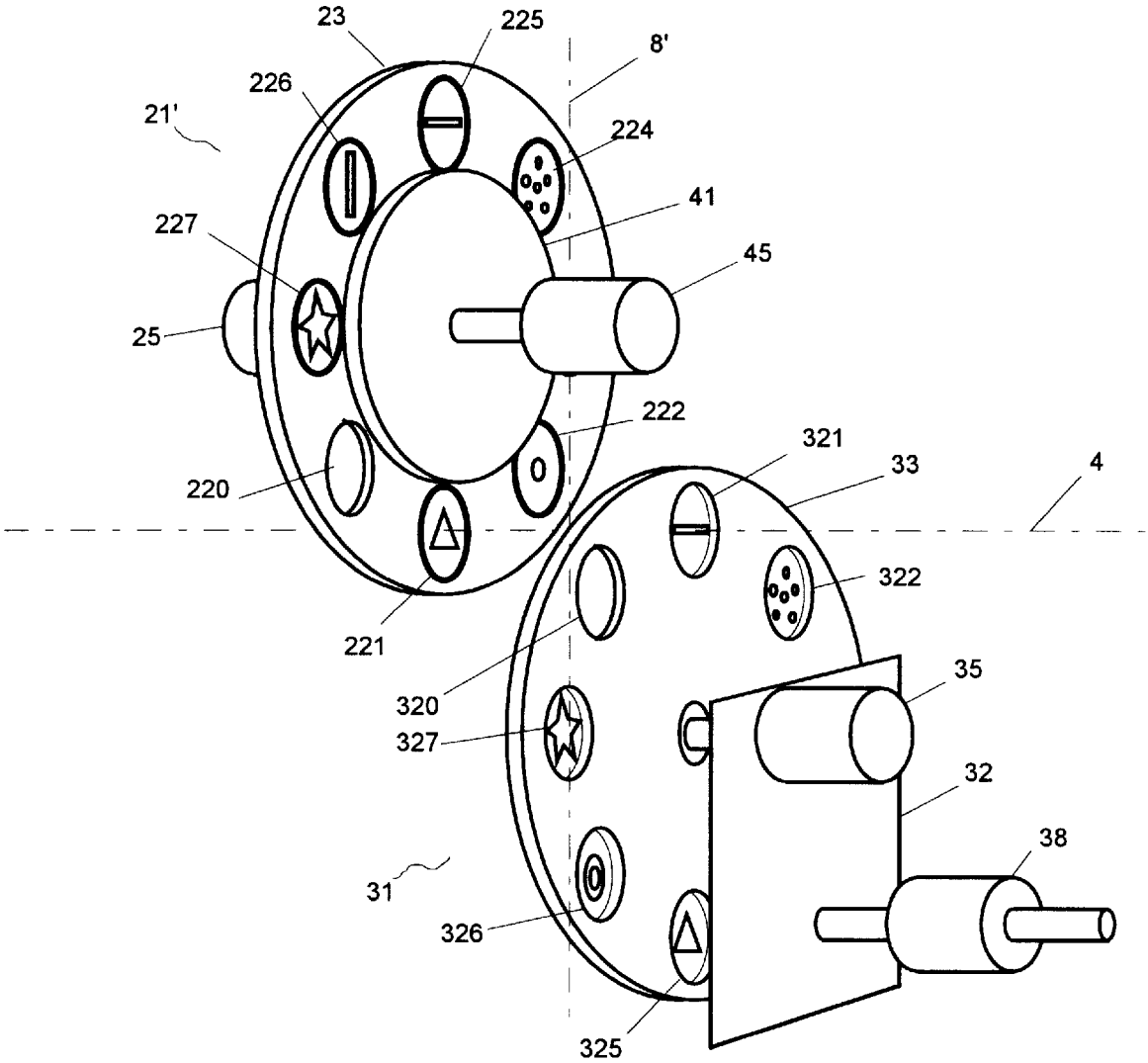
FIG. 5 is a perspective view of a projection gate apparatus according to a second aspect of the present invention.

An alternate arrangement of the first and second gobo carriages shown in FIG. 4 and FIG. 5, provides for accommodation of a gobo rotator mechanism such as disclosed in U.S. Pat. No. 5,537,303 said patent being incorporated by reference herein. In this alternate arrangement, first gobo carriage 21' is disposed on an opposite side of optical axis 4 from gobo carriage 31 to provide clearance for a gobo rotator mechanism, including gobos 221–227 rotatably mounted to wheel 23 and engaged by a sun gear 41 coupled to a shaft 44 of motor 45 under the control of motor drive circuit 46 having control input terminals 47. Sun gear 41 engages each gobo 221–227 such that as sun gear 4 rotates so does each gobo. A similar gobo rotator mechanism may also be provided for second gobo carriage 31.

Figure 6:
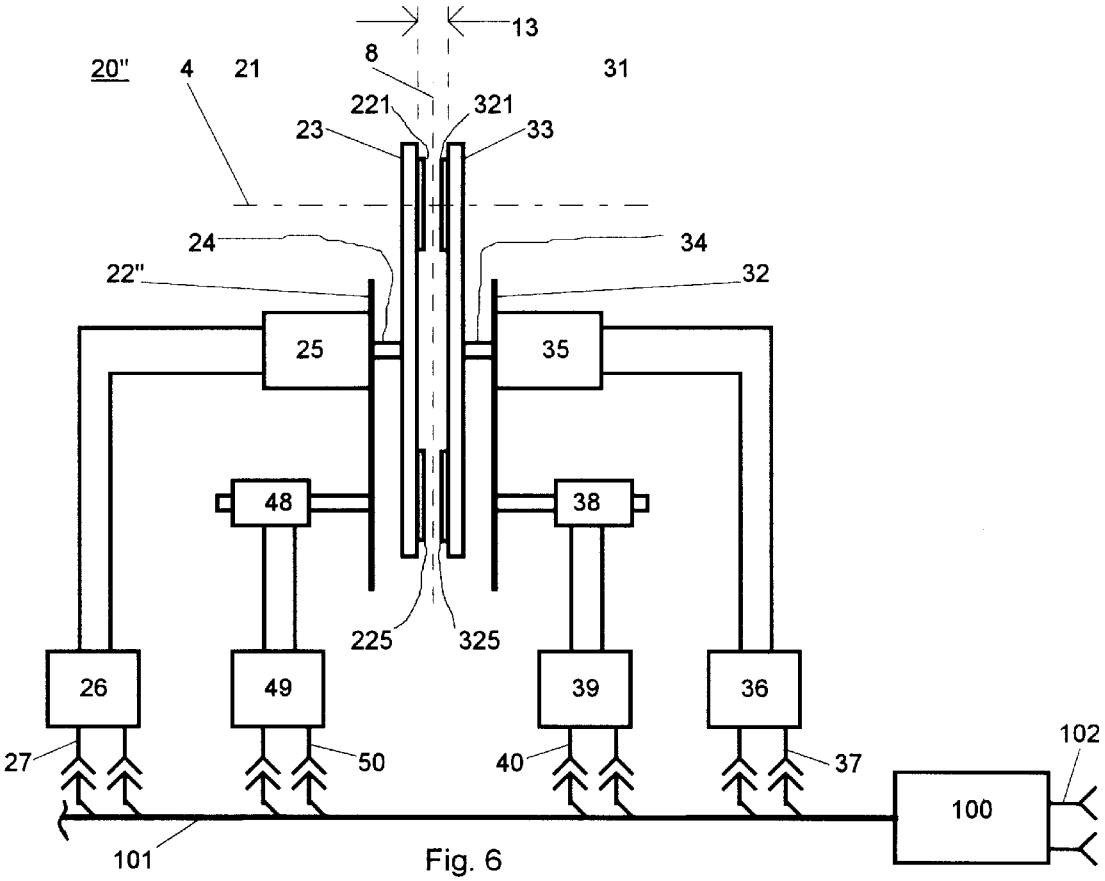
FIG. 6 is a schematic side elevation of a projection gate apparatus according to a third aspect of the present invention.

According to another aspect of the present invention shown in FIG. 6, projection gate apparatus 20" includes a movable support carriage 22" provided for first gobo carriage 21" such that the longitudinal position of a gobo supported by the first gobo carriage is also adjustable along the optical axis, thereby providing for a variety of optical effects as the position of the two gobos and the position of the object plane of the projection lens are varied.

Figure 7:
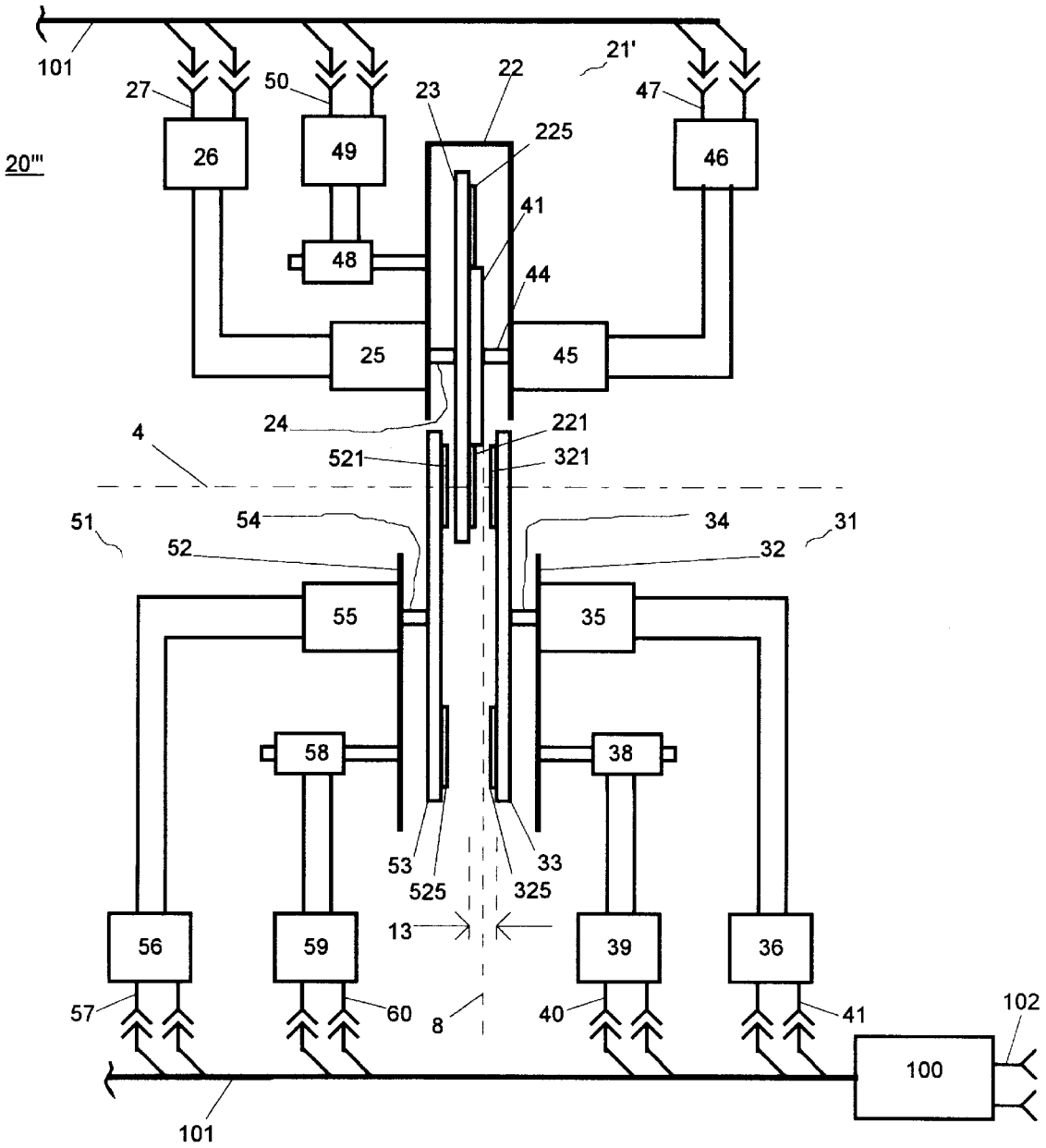
FIG. 7 is a schematic side elevation of a projection gate apparatus according to a fourth aspect of the present invention.

According to another aspect of the present invention shown in FIG. 7, projection gate apparatus 20"' includes a third gobo carriage 51 comprising a plurality of gobos 521–527 mounted about the periphery of a wheel 53 mounted on a shaft 54 of a motor 55 under control of motor drive circuit 56 having control input terminals 57, which may also be supported by a movable support carriage 52 having a motorized mechanism 58 coupled to the support carriage and operated via a motor drive circuit 59 having control input terminals 60, thereby providing for a variety of optical effects involving combinations of up to three images. Two images might be in sharp focus while a third image provides soft or diffuse effects, the third image being out of focus. Alternatively, one image might be in sharp focus while two other images provide soft or diffuse effects, the other two images being out of focus. Further, a dissolve can be accomplished by spacing three images along the optical axis such that no two images can lie within the depth-of-field of the projection lens, and then sweeping the lens throughout a range of travel which brings each of the three images successively into focus and then out of focus, thereby morphing from one image to another image to yet another image. Alternatively, the lens might remain stationary while three movable support carriages in concomitant motion sweep their respective gobos through the depth-of-field of the projection lens. Gobo carriage support 22 can be made movable with the addition of a motorized mechanism 48 coupled thereto, the mechanism operated via motor drive circuit 49 having control input terminals 50.

Figure 8:
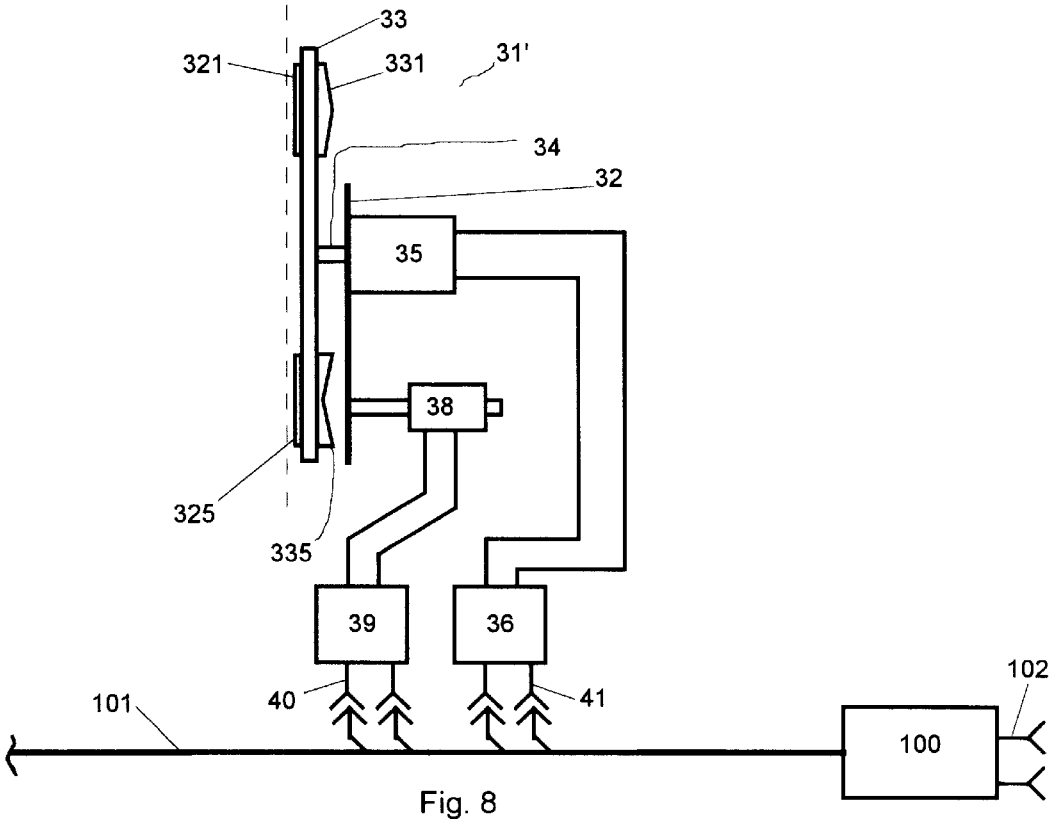
FIG. 8 is a schematic side elevation of a projection gate apparatus according to a fifth aspect of the present invention.

According to another aspect of the present invention shown in FIG. 8, a gobo carriage 31' supports an image-forming gobo 321 on one surface of the carriage and supports another light modifying device such as a prism 331 or other refractive element 335 on an opposite surface of the carriage. When the prism or other refractive element is positioned coaxially with the optical axis, the longitudinal position of the object plane relative to the gobo and the prism can be varied to provide for a variety of optical effect as the lens is focused upon either the gobo or the prism, both, or neither; dynamic effects also being possible as the relative longitudinal positions of the optical elements are varied while the lamp is energized and a light beam is consequently projected.

It should be recognized that static or dynamic optical effects can be produced by the invention in any of its aspects, providing that any movable support carriages are motorized and are operable by manual or preprogrammed, local or remote control; a variety of suitable control arrangements being well-known. For example, three or more gobo exchanger wheels can be mounted in close proximity and supported by a single movable support carriage operable to position any one gobo or two adjacent gobos within the depth of field of the object plane. It should also be recognized that the invention is practicable by locating the disclosed projection gate apparatus adjacent to a focal point of a focused-beam optical system as shown herein, or by locating the apparatus of the present invention in any collimated portion of a light beam wherein the image-forming elements are illuminated and can be brought within a depth-of-field of a projection lens.

I claim:

1. A projection optical system, comprising:

a lamp coupled with a reflector for projecting a light beam along an optical axis, a projection gate apparatus, and a projection lens having an object plane;

said projection lens being movable so as to adjust the location of said object plane along said optical axis;

said projection gate apparatus including a first gobo carriage having a first image pattern generator and a second gobo carriage having a second image pattern generator:

said second gobo carriage being movable along said optical axis;

said lens and said second gobo carriage being operable to place either or both of said first and second image pattern generators within a depth-of-field of said object plane.

2. The projection optical system according to claim 1 further including a third gobo carriage movable along said optical axis, said third gobo carriage having a third image pattern generator.

3. The projection optical system according to claim 2 wherein said first gobo carriage is movable along said optical axis.

4. A method for controlling images to be projected by a projection optical system, comprising the steps of:

moving a lens along an optical axis of said projection optical system to focus upon a first gobo;

moving a second gobo along said optical axis so that both gobos are in focus.

5. The method of claim 4, further comprising the step of moving said second gobo and said lens so that said first gobo goes out of focus and said second gobo remains in focus.

6. The method of claim 4, further comprising the step of moving said second gobo along said optical axis so that only the first gobo is still in focus.

7. A method for controlling images to be projected by a projection optical system, comprising the steps of:

moving a first gobo along an optical axis of said projection optical system to place said first gobo within a depth of field of an object plane of a projection lens.

8. The method of claim 7, further comprising the step of moving a second gobo along said optical axis of said projection optical system to place said second gobo within a depth of field of an object plane of a projection lens.

9. The method of claim 8, further comprising the step of moving either said first gobo or said second gobo along said optical axis to remove either of said gobos out of said depth of field.

10. In a stage lighting instrument including an image projection optical system having plural axial locations along an optical axis thereof, a method of controlling the focus of plural sequential image pattern generators coincident with said optical axis in a projection gate apparatus, comprising the steps of:

controlling the axial location of at least one element of a projection lens system to locate an object plane of said lens system within said projection gate apparatus, and controlling the axial location of at least one of said image pattern generators to vary the axial separation of at least two of said image pattern generators within said projection gate apparatus.

11. A projection gate apparatus for use in a projection optical system having a lamp coupled with a reflector for projecting a light beam along an optical axis and a projection lens movable along said optical axis, said projection lens defining an object plane, said projection gate comprising:

a first carriage for supporting a first image pattern generator;

a second carriage for supporting a second image pattern generator, and a translator for moving said second carriage along said optical axis such that either or both of said first and image pattern generators can be disposed within a depth of field of said object plane.

12. A projection gate apparatus according to claim 11 further comprising a third carriage supporting a third image pattern generator and a translator for moving said third carriage along said optical axis.

13. A projection gate apparatus according to claim 11 wherein said first and second carriages are disposed on opposite sides of said optical axis.

14. A projection gate apparatus according to claim 12 further comprising a translator for moving said first carriage along said optical axis.

15. A method for controlling images to be projected by a projection optical system having a lamp coupled with a reflector for projecting a light beam along an optical axis, and a projection lens having a depth of field, said method comprising the steps of providing a first image pattern generator along said optical axis, providing a second image generator along said optical axis, and locating said second image pattern generator and said projection lens along said optical axis so as to place either or both of said image pattern generators within the depth of field of said lens.

16. A projection optical system comprising:

a lamp for projecting a light beam along an optical axis;

a projection lens disposed along said optical axis said projection lens having a depth of field;

a first linear translator associated with said projection lens and capable of moving said lens along said optical axis;

first and second image pattern generators disposed along said optical axis;

a second linear translator associated with said second image pattern generator capable of moving said second image pattern along said optical axis;

a controller associated with said first and second linear translators for coordinating the movement of said projection lens and said second image pattern generator to place either or both of said image pattern generators in the depth of field of said projection lens.

* * * * *